United States Patent [19]

Pace

[11] 4,259,756

[45] Apr. 7, 1981

[54] MOVEABLE TOP STRETCHER

[76] Inventor: Paul D. Pace, 347 72nd St., Brooklyn, N.Y. 11209

[21] Appl. No.: 70,482

[22] Filed: Aug. 28, 1979

[51] Int. Cl.[3] ..... A47B 83/04; A61G 1/02

[52] U.S. Cl. ..... 5/81 B; 5/86; 5/425

[58] Field of Search ..... 5/81 R, 81 B, 86, 425; 312/335, 341 R, 345; 297/248

[56] References Cited

U.S. PATENT DOCUMENTS

| | | | |
|---|---|---|---|
| 2,528,048 | 10/1950 | Gilleland | 5/81 B |
| 3,015,114 | 1/1962 | Seib | 5/86 |
| 3,147,039 | 9/1964 | Smith et al. | 5/86 |
| 4,011,609 | 3/1977 | Bethlen | 5/81 B |

*Primary Examiner*—Casmir A. Nunberg

*Attorney, Agent, or Firm*—Richard L. Miller

[57] ABSTRACT

A hospital stretcher, including a chassis frame mounted on wheels, and a stretcher frame carried upon the wheeled chassis frame, transverse extending rails across a top of the chassis frames so that a ball bearing suspension mounted on an underside of the stretcher frame, allows the stretcher frame to be sidewardly moved a part way upon a bed so as to more easily permit transfer of a patient therebetween.

1 Claim, 5 Drawing Figures

MOVEABLE TOP STRETCHER

BACKGROUND OF THE INVENTION

This invention relates generally to hospital stretchers that are mounted upon wheels, for use in transporting a patient between his bed and an operating room or the like.

It is well known to those working the particular field, that in transfering a patient between a bed and a wheeled stretcher, the stretcher is brought closely alongside the bed and its wheels braked so the patient can then be lifted by hospital attendants or nurses in order to be carried across the gap between the bed and stretcher. This requires one or more persons who are strong enough so as to be able to carry the patent across the gap, so that this situation is accordingly in need of an improvement.

SUMMARY OF THE INVENTION

Therefore it is a principal object of the present invention to provide a wheeled hospital stretcher which includes a top stretcher frame that is movable a part way upon a top of a bed so that it is easier to transfer a patient therebetween, by simply rolling the patient over.

Another object accordingly is to provide a movable top stretcher which allows one nurse or attendant working alone, to do the task, and without the need of great strength or requiring great effort.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF PREFERRED EMBODIMENT

Figures 1, 2, 3, 4, 5:
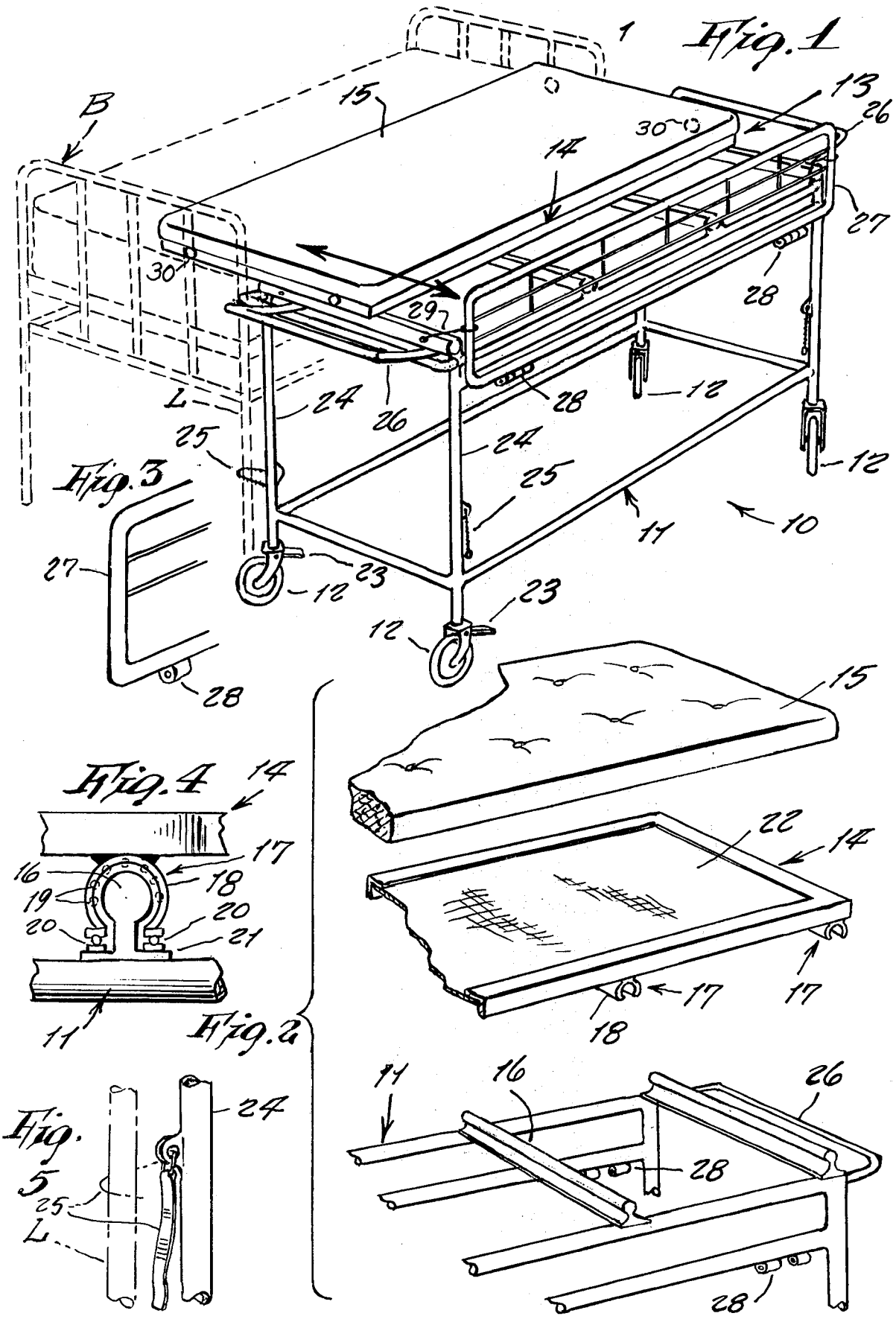
FIG. 1 is a perspective view of the invention showing the stretcher thereof drawn over an edge of a bed attached to the invention.
FIG. 2 is an exploded perspective fragmentary view of the mattress, stretcher and main frame of the invention.
FIG. 3 is a detail of the side railing.
FIG. 4 is an end view of one of the stretcher slide support rails.
FIG. 5 is a detail of the lock for attachment to a bed.

Referring now to the drawing in greater detail, the reference numeral 10 represents a movable top stretcher assembly, according to the present, invention, wherein there is a mainframe or chassis frame 11 mounted upon wheels 12 so as to travel across the floor, and the chassis frame carrying a stretcher 13 thereupon consisting of a stretcher frame 14 and a mattress 15 placed upon it.

In the present invention, four rails 16 are affixed on top of the chassis frame, the rails extending thereacross in a transverse direction, as shown in FIGS. 2 and 4. The figures also show ball bearing suspensions 17 affixed transversely to the underside of the stretcher frame for traveling upon the rails, each suspension comprising a channel 18 for fitting around a top of the rail, and ball bearings 19 on its inner face for rolling on the surface of the rail; also a row of ball bearings 20 along each edge of the channel for travel on the rail flanges 21.

The stretcher frame includes a stretched canvas 22 therein and upon which the mattress rests.

Each wheel of the chassis frame concludes a foot-operated brake 23. Also each leg 24 of the chassis frame includes a flexible thong 25 attached thereto for tying aroung a leg L of the bed B as an additional securement while a patient is being transfered.

The drawing further shows the movable top stretcher additionally includes handbars 26 at each end of the chassis frame for pulling or pushing the device, and it also includes side railings 27 for protecting a patient from rolling off while traveling; the side railings being pivotable down about hinges 28 so as to be out of the way when the stretcher frame is pulled out sidewardly. The railings are retained in upwardly pivoted position by latches 29.

The device shown in FIG. 1 shows the rails on suspension in reversed order as a modified design of the invention.

In operative use, when the device 10 is brought to a bed for transfer of a patient, the side railing facing the bed is first lowered, and the device is brought close alongside the bed. The thongs are lashed to the bed posts and the wheel brakes then applied. The stretcher frame is then pulled sideward so to extend upon the bed as shown in FIG. 1, and the patient is then rolled on or off after the movable top is locked secure in the desired position over the hospital bed, by a vice or a screw type of lock 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A movable top stretcher assembly, comprising in combination, a mainframe and chassis frame mounted on wheels, and a stretcher upon said chassis frame comprising a stretcher frame and a mattress thereupon, and means to slide said stretcher transversely to either side and upon a bed; said means comprising a plurality of transverse rails and a ball bearing suspension for each said rail; said suspension comprising a transversely circular cross section, longitudinally slitted channel for fitting on said rail, and ball bearings on an inner face of said channel for rolling on a surface of said rail; a means for lashing said assembly to the legs of a bed; and each of said wheels including a foot-operated brake.

* * * * *